US006129295A

United States Patent [19]

Johansson

[11] Patent Number: 6,129,295

[45] Date of Patent: Oct. 10, 2000

[54] DEVICE IN SPRAY GUNS PROVIDED WITH HOSES

[75] Inventor: Stig Johansson, Rönninge, Sweden

[73] Assignee: Ecco Finishing AB, Skara, Sweden

[21] Appl. No.: 09/284,345

[22] PCT Filed: Sep. 11, 1997

[86] PCT No.: PCT/SE96/01531

§ 371 Date: Apr. 14, 1999

§ 102(e) Date: Apr. 14, 1999

[87] PCT Pub. No.: WO98/28087

PCT Pub. Date: Jul. 2, 1998

[30] Foreign Application Priority Data

Dec. 20, 1996 [SE] Sweden ..... 9604722

[51] Int. Cl.[7] ..... B05B 7/02

[52] U.S. Cl. ..... 239/525; 239/423; 239/526; 239/DIG. 14; 285/120.1; 285/132.1

[58] Field of Search ..... 239/423, 525, 239/526, DIG. 14; 248/75; 285/120.1, 122.1, 123.15, 132.1

[56] References Cited

U.S. PATENT DOCUMENTS

| | | | |
|---|---|---|---|
| 24,179 | 5/1859 | McLeod | 285/132.1 X |
| 2,475,635 | 7/1949 | Parsons | 285/123.15 |
| 2,663,325 | 12/1953 | Bede | 285/122.1 |
| 2,736,949 | 3/1956 | Kraemer | 285/132.1 X |
| 2,984,419 | 5/1961 | Mcuat | 239/525 X |
| 4,368,219 | 1/1983 | Nagata et al. . | |
| 5,195,680 | 3/1993 | Holt | 285/132.1 X |
| 5,267,693 | 12/1993 | Dickey . | |

FOREIGN PATENT DOCUMENTS

| | | |
|---|---|---|
| 387256B | 9/1976 | Sweden . |
| 9104103 | 4/1991 | WIPO . |

*Primary Examiner*—Andres Kashnikow
*Assistant Examiner*—Robin O. Evans
*Attorney, Agent, or Firm*—Young & Thompson

[57] ABSTRACT

A spray gun (1) includes a head (2) having an element (5) for connecting a liquid hose (7) as well as a handle member (3) having a member (6) for connecting a compressed air hose (8). The liquid hose (7) is, along the major part of the length thereof, drawn inside the wider compressed air hose (8), a coupling part (10) of the multi-way type being connected to the connection member (6) of the handle member (3). The coupling part includes a main duct (11) for compressed air, as well as at least one branch duct (14), extending at an angle to the main duct, through which the liquid hose (7) is drawn and which includes at least one sealing (18) which air-proofly cuts off an annular gap between the inside of the branch duct and the outside of the liquid hose.

20 Claims, 1 Drawing Sheet

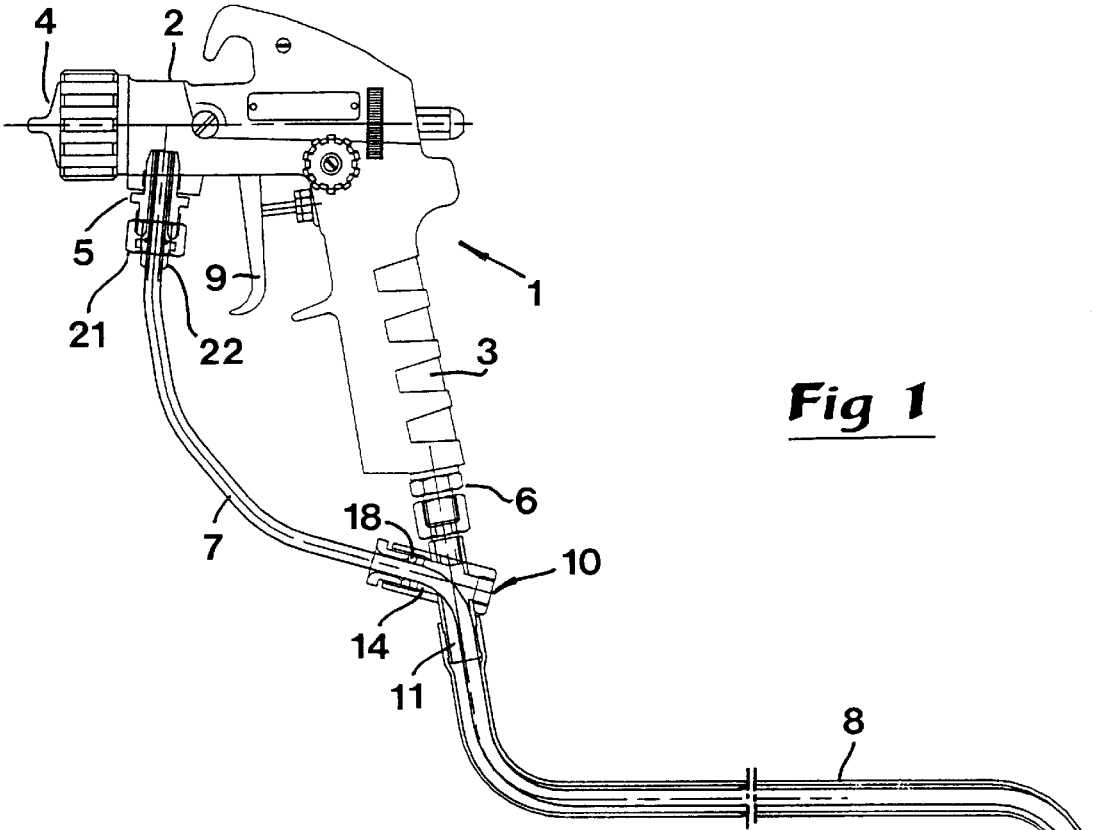
Fig 1
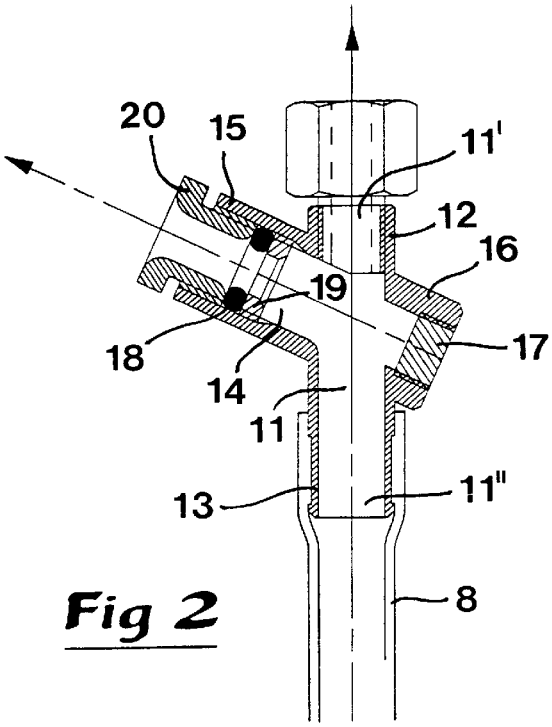
Fig 2
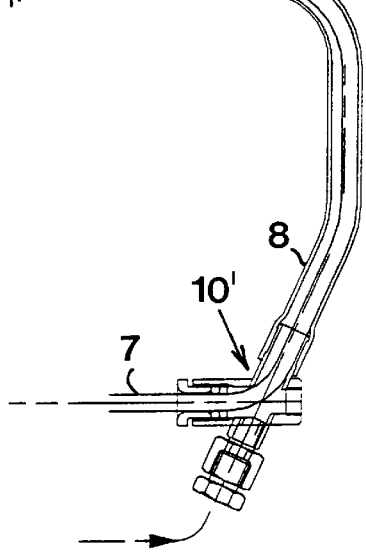

DEVICE IN SPRAY GUNS PROVIDED WITH HOSES

CROSS REFERENCE TO RELATED APPLICATION

This is the 35 USC 371 National Stage of International application PCT/SE97/01531 filed on Sep. 11, 1997 which designated the United States of America.

TECHNICAL FIELD OF THE INVENTION

This invention relates to a device in spray guns provided with hoses of the kind which comprise a head having means for connecting at least a first hose for feeding liquid from a liquid source distanced from the gun as well as a handle member having means for connecting a second, coarser hose for feeding compressed air from a compressed air source likewise distanced from the gun, the compressed air having the purpose of atomizing the liquid into fine particles at the latest when said liquid leaves a nozzle included in the gun head.

BACKGROUND OF THE INVENTION

In spray guns of the kind generally referred to above, the liquid source and compressed air source are usually located at a large distance from the gun, for instance within the range of 5–15 meters or more. Thus, in previously known spray guns, the long hoses run separated from each other from the gun to the sources for liquid and compressed air, respectively. In practice, this implies that the handling of the hoses is complicated. It often happens that the hoses get entangled in each other and/or in other objects in the surroundings, in particular when a spray gun is used in narrow spaces or in spaces which are cluttered up with objects, and requires frequently recurring removals. Therefore, in order to facilitate the handling of the hoses in practice, the temporary measure of connecting the hoses side by side next to each other by means of a plurality of longitudinally separated point connection elements, such as tape, strings, insulating tape or the like, is often taken. However, such provisional arrangements do not constitute any satisfactory solution of the problem, since the individual connection elements easily get stuck in surrounding objects when the hoses held together are drawn in either direction along the length extension thereof.

OBJECTS AND FEATURES OF THE INVENTION

The present invention aims at obviating the above-mentioned inconveniences of previously known spray guns and at providing an improved hose drawing device for such guns. Thus, a primary object of the invention is to provide a hose drawing device in which the risk of tangling the different hoses is eliminated. It is also an object to provide a hose drawing device which clears away the risk of the hoses getting stuck in different objects when they are drawn along the length extension thereof. Another object of the invention is to provide a hose drawing device, which is proper and simple.

According to the invention, at least the primary object is attained by the features defined in the main claim. Preferred embodiments of the hose drawing device according to the invention are furthermore defined in the dependent claims.

BRIEF DESCRIPTION OF THE APPENDED DRAWING

In the drawing:

FIG. 1 is a schematic view showing a spray gun together with an associated hose drawing device according to the invention, and FIG. 2 is a section on an enlarged scale through a coupling portion characteristic for the hose drawing device.

DETAILED DESCRIPTION OF A PREFERRED EMBODIMENT OF THE INVENTION

In FIG. 1, numeral 1 generally designates a spray gun, which comprises a head 2 and a handle member 3 protruding at an angle from the rear end portion thereof. There is a nozzle generally designated 4 at the front end of the gun head 2. A hose connection means 5, which in the example is in the shape of a nipple, is arranged at the bottom of the head 2. An analogous nipple 6 is also mounted on the lower, free end of the handle member 3. A first, relatively thin hose is designated by 7, the purpose of which is to feed liquid to a chamber (not shown) included in the gun head. A second, coarser hose 8 has the purpose of feeding compressed air to the gun, more precisely to a compressed air duct (not shown) inside the gun mouthing in the nipple 6. A trigger finger 9 has the purpose of activating the gun with the purpose of ejecting liquid via the nozzle 4. In this connection, it should be pointed out that the compressed air (or other pressurized gas) has the purpose of atomizing the fed liquid into fine particles at the latest when the liquid leaves the nozzle 4.

As far as the shown spray gun together with the hoses thereof have been outlined to this point, said spray gun is in all essentials previously known. In practice, such spray guns are often used for spraying paint.

Characteristic for the present invention is that the relatively thin liquid hose 7, along the major part of the length thereof, is drawn inside the coarser compressed air hose 8. In order to realize this drawing of the hoses, a coupling part of the multiple-way type, in its entirety designated 10, which is shown on an enlarged scale in FIG. 2, is connected to the nipple 6 of the handle member. A main duct 11, one end 11' of which communicates with the compressed air duct of the handle part 3, more precisely through the nipple 6, is included in said coupling part. The opposite end 11" of the main duct 11 communicates with the compressed air hose 8. In the embodiment shown in the drawing, the main duct 11 is delimited by pipe walls 12, 13, which jointly have the character of a through pipe. In practice, the compressed air hose 8 may have the end portion thereof applied outside the pipe wall 13, the hose being held in place by means of a suitable (not shown) work-holder.

A branch duct 14, through which the liquid hose 7 may be brought out from the coupling part, extends at an angle to the main duct 11. Also this branch duct is, in the shown example delimited, by a pipe wall 15, which advantageously is made integrally with the pipe walls 12, 13. There is also a fourth pipe wall 16, diametrically opposite the pipe wall 15, the opening mouth of which is closed by means of a plug 17. A sealing, which in the example is constituted by a gland packing, is arranged in the branch duct 14. The gland packing includes at least one elastic sealing ring 18, for instance an O-ring, which is placed between, on one hand, a fixed, ring-shaped shoulder 19 on the inside of the pipe wall 15 and, on the other hand, an axially movable, screwable sleeve 20. This sleeve has a male thread on the outside thereof which meshes with a corresponding female thread on the inside of the pipe wall 15. When the sleeve 20 is screwed into the branch duct, the sealing ring 18 is compressed. In this way, an efficient sealing of the annular gap between the outside of the liquid hose and the inside of the branch duct is brought about at the same time as the sealing ring, through squeezing, holds the liquid hose in the desired position.

The branch duct 14 should extend at an acute angle to the outlet end 11' of the main duct 11. In practice, this angle between the two ducts respectively should be within the range of 50–80°, suitably 60–70°. In the shown example, the angle is 65°. By the fact that the branch duct is oblique in this way, the liquid hose 7 may be formed to a softly bent configuration having a relatively large bending radius in the area where it passes through the coupling part. In other words, the liquid hose may be drawn through the coupling part without any risk for abrupt folds or other flow-limiting deformations arising.

In accordance with a preferred embodiment of the invention, the liquid hose 7 is made of a material having a smooth surface structure, for instance polytetrafluoro ethylene. At least an external surface layer of a smooth material, i.e. a material having a low coefficient of friction, should be included in the hose. Thus, by the fact that the surface of the hose has a low coefficient of friction, the liquid hose inside the compressed air hose 8 offers a minimum of resistance to the passage of the air inside the hose 8. In this connection, it should also be pointed out that the liquid hose 7 should in practice have an external cross-sectional area, which is markedly less than the internal cross-sectional area of the compressed air hose. The cross-sectional area of the inner hose should suitably attain maximum 50% of the internal cross-sectional area of the outer hose.

In the shown, preferred embodiment of FIG. 1, the compressed air hose 8 is, at the end thereof distanced from the spray gun 1, connected to a second coupling part 10' of the same kind as the above-described coupling part 10. In this way, a simple connection of the compressed air hose to the compressed air source (not shown) in question is enabled, at the same time as the liquid hose 7 may be linked off in a simple way to the liquid source (not shown).

It may also be pointed out that the spray gun shown in the drawing is different from previously known spray guns in respect of the connection of the liquid hose 7 to the gun head. Thus, in previously known spray guns, the liquid hose is applied outside the nipple 5, which is of a conventional type per se. This solution implies in practice that such a liquid as paint may get stuck and dry in the interface between the hose and the lower end of the nipple, and then flakes of dried paint may be pulled loose by the passing paint liquid and finally form projections in the paint layer which is sprayed by means of the gun.

Contrary to this, the liquid hose 7 of the gun according to the invention is drawn inside the nipple 5 and coupled thereto by means of a nut 21 which presses a flange-mounted sleeve 22 against the lower end of the nipple. In the space between the sleeve 22 and the nipple, there is an O-ring or the like, which at tightening is compressed and clamps the hose in the desired position. In this way, the hose will be drawn in an unbroken configuration from the liquid store to the chamber inside the gun head.

The advantages of the invention should be evident. By the fact that the relatively slender liquid hose, along the major part of the length thereof, is drawn through the compressed air hose in its entirety, the compressed air hose will form a single integrated hose unit for the supply of the requisite fluids from the individual fluid sources. Thus, the risk of tangling the separated hoses is eliminated at the same time as the wide compressed air hose does not risk to get stuck in surrounding objects in case it is drawn in the axial extension in either direction. In other words, the hose drawing becomes simple, proper and practical.

Feasible Modifications of the Invention

The invention is not solely restricted to the embodiment described and shown in the drawing. Thus, it is feasible to draw more than only one liquid hose inside the wider compressed air hose. Thus, it is feasible to draw two liquid conduits, each one feeding different liquids to the head of the spray gun, in the wider hose. In such cases, the coupling part 10 is formed with as many branch ducts (together with the appurtenant sealings) as the number of desired liquid hoses. It may also be pointed out that the coupling part may be physically formed in another way than in the form of two tube or tube-like details directed at an angle to each other. Thus, it is conceivable to drill, or in another way form, at least two mutually oblique bores which form a main duct for feeding compressed air as well as at least one branch duct for a liquid hose, inside a block.

What is claimed is:

1. A device in a spray gun provided with hoses, which comprises a head having connecting means for connecting at least a first hose for feeding liquid from a liquid source distanced from the gun, and a handle member having connection means for connecting a second, wider hose for feeding compressed air from a compressed air source likewise distanced from the gun, the compressed air having the purpose of atomizing the liquid into fine particles at the latest when said liquid leaves a nozzle included in the gun head; wherein the liquid hose along the major part of the length thereof is drawn inside the wider compressed air hose and a first multi-way coupling part is connected to the connection means of the handle member, said coupling part including a main duct which, at one end thereof, communicates with a compressed air duct of the handle member, and at the opposite end thereof communicates with the wide compressed air hose, and at least one branch duct, extending at an angle to the main duct, through which the liquid hose is drawn and which comprises at least one sealing which air-proofly cuts off an annular gap between the inside of the branch duct and the outside of the liquid hose.

2. The device according to claim 1, wherein the branch duct extends at an acute angle to the main duct ranging between 50–80°.

3. The device according to claim 2, wherein the acute angle ranges between 60–70°.

4. The device according to claim 1, wherein the sealing consists of a gland sealing comprising an elastic sealing ring arranged between a screwable sleeve and a fixed shoulder in the branch duct.

5. The device according to claim 1, wherein the liquid hose, at least at the outside thereof, is made of a smooth material having a low coefficient of friction.

6. The device according to claim 5, wherein the smooth material is polytetrafluoro ethylene.

7. The device according to claim 1, wherein the compressed air hose at the end thereof distanced from the spray gun is connected to a second multi-way coupling part, and the liquid hose is sealingly brought through the branch duct to said second multi-way coupling part.

8. The device according to claim 2, wherein the sealing consists of a gland sealing comprising an elastic sealing ring arranged between a screwable sleeve and a fixed shoulder in the branch duct.

9. The device according to claim 2, wherein the liquid hose, at least at the outside thereof, is made of a smooth material having a low coefficient of friction.

10. The device according to claim 9, wherein the smooth material is polytetrafluoro ethylene.

11. The device according to claim 4, wherein the liquid hose, at least at the outside thereof, is made of a smooth material having a low coefficient of friction.

12. The device according to claim 8, wherein the liquid hose, at least at the outside thereof, is made of a smooth material having a low coefficient of friction.

13. The device according to claim 2, wherein the compressed air hose at the end thereof distanced from the spray gun is connected to a second multi-way coupling part, and the liquid hose is sealingly brought through the branch duct to said second multi-way coupling part.

14. The device according to claim 4, wherein the compressed air hose at the end thereof distanced from the spray gun is connected to a second multi-way coupling part, and the liquid hose is sealingly brought through the branch duct to said second multi-way coupling part.

15. The device according to claim 5, wherein the compressed air hose at the end thereof distanced from the spray gun is connected to a second multi-way coupling part, and the liquid hose is sealingly brought through the branch duct to said second multi-way coupling part.

16. The device according to claim 8, wherein the compressed air hose at the end thereof distanced from the spray gun is connected to a second multi-way coupling part, and the liquid hose is sealingly brought through the branch duct to said second multi-way coupling part.

17. The device according to claim 9, wherein the compressed air hose at the end thereof distanced from the spray gun is connected to a second multi-way coupling part, and the liquid hose is sealingly brought through the branch duct to said second multi-way coupling part.

18. The device according to claim 11, wherein the compressed air hose at the end thereof distanced from the spray gun is connected to a second multi-way coupling part, and the liquid hose is sealingly brought through the branch duct to said second multi-way coupling part.

19. The device according to claim 12, wherein the compressed air hose at the end thereof distanced from the spray gun is connected to a second multi-way coupling part, and the liquid hose is sealingly brought through the branch duct to said second multi-way coupling part.

20. The device according to claim 19, wherein the smooth material is polytetrafluoro ethylene.

* * * * *